US011945633B2

(12) United States Patent
Collier

(10) Patent No.: US 11,945,633 B2
(45) Date of Patent: Apr. 2, 2024

(54) TAMPER EVIDENT BLISTER PACKAGING

(71) Applicant: PERFETTI VAN MELLE BENELUX BV, HK Breda (NL)

(72) Inventor: Paul Collier, Newton, NJ (US)

(73) Assignee: INTERCONTINENTAL GREAT BRANDS LLC, East Hanover, NJ (US)

( * ) Notice: Subject to any disclaimer, the term of this patent is extended or adjusted under 35 U.S.C. 154(b) by 24 days.

(21) Appl. No.: 17/773,560

(22) PCT Filed: Nov. 12, 2020

(86) PCT No.: PCT/US2020/060199
§ 371 (c)(1),
(2) Date: Apr. 29, 2022

(87) PCT Pub. No.: WO2021/097072
PCT Pub. Date: May 20, 2021

(65) Prior Publication Data

US 2022/0371802 A1 Nov. 24, 2022

Related U.S. Application Data

(60) Provisional application No. 62/935,446, filed on Nov. 14, 2019.

(51) Int. Cl.
*B65D 75/36* (2006.01)
*B65D 55/08* (2006.01)
*B65D 83/04* (2006.01)

(52) U.S. Cl.
CPC ..... *B65D 75/367* (2013.01); *B65D 55/0818* (2013.01); *B65D 83/0463* (2013.01);
(Continued)

(58) Field of Classification Search
CPC ..... B65D 2583/0454; B65D 2575/366; B65D 2575/363; B65D 83/0463; B65D 55/0818; B65D 75/367; B65D 5/38
(Continued)

(56) References Cited

U.S. PATENT DOCUMENTS 5,172,812 A * 12/1992 Wharton ..... B65D 75/367 206/532
7,093,716 B2 * 8/2006 Intini ..... B65D 75/367 206/532
(Continued)

FOREIGN PATENT DOCUMENTS

EP 0162378 A2 11/1985
EP 0771737 A1 5/1997
(Continued)

OTHER PUBLICATIONS

Extended European Search Report issued in European Application No. 23152198.0, dated Jul. 11, 2023, 6 pages.
(Continued)

*Primary Examiner* — Chun Hoi Cheung
(74) *Attorney, Agent, or Firm* — CANTOR COLBURN LLP

(57) ABSTRACT

A tamper evident package comprises a blister assembly defining at least one cavity, the opening of the at least one cavity being at least partially closed by a membrane. A sleeve housing the blister assembly is provided, the sleeve having a top side and a bottom side, the bottom side having a contact window that is aligned with the cavity. In addition, a package integrity feature is applied to the bottom side and covers the contact window. The package integrity feature is further applied to the membrane covering the cavity through the contact window.

23 Claims, 6 Drawing Sheets

(52) U.S. Cl.
CPC .. *B65D 2575/363* (2013.01); *B65D 2575/366* (2013.01); *B65D 2583/0454* (2013.01)

(58) Field of Classification Search
USPC ..... 206/528–540, 1.5; 229/125.125
See application file for complete search history.

(56) References Cited

U.S. PATENT DOCUMENTS

| | | | | |
|---|---|---|---|---|
| 7,464,818 | B2 * | 12/2008 | Gherdan | B65D 83/0463 206/532 |
| 7,967,143 | B2 * | 6/2011 | Paliotta | B65D 75/327 206/532 |
| 9,472,124 | B2 * | 10/2016 | Ludwig | G09F 3/0292 |
| 9,855,190 | B2 * | 1/2018 | Knutson | B65D 75/327 |
| 10,206,851 | B1 * | 2/2019 | Gherdan, Jr. | B65D 83/0463 |
| 2004/0182739 | A1 | 9/2004 | Williams-Hartman | |
| 2007/0034543 | A1 | 2/2007 | Jones | |
| 2007/0056876 | A1 * | 3/2007 | Jones | B65D 75/327 206/538 |
| 2007/0068844 | A1 | 3/2007 | Weston | |
| 2007/0221534 | A1 | 9/2007 | Intini | |
| 2007/0235367 | A1 * | 10/2007 | Initini | A61J 1/035 206/531 |
| 2008/0078690 | A1 * | 4/2008 | Zumbiel | B65D 83/0463 206/534 |
| 2009/0178949 | A1 | 7/2009 | Reilley et al. | |
| 2011/0266189 | A1 | 11/2011 | Tom et al. | |
| 2018/0282040 | A1 | 10/2018 | Bracht | |

FOREIGN PATENT DOCUMENTS

| | | | |
|---|---|---|---|
| EP | 2336045 | A1 | 6/2011 |
| FR | 1527556 | A | 5/1968 |
| GB | 2296700 | A | 7/1996 |
| JP | 2016528931 | A | 9/2016 |
| WO | 9505323 | A1 | 2/1995 |
| WO | 0238454 | A1 | 5/2002 |
| WO | 03066323 | A1 | 8/2003 |
| WO | 2006079191 | A1 | 8/2006 |
| WO | 2007002489 | A2 | 1/2007 |
| WO | 2007024897 | A2 | 3/2007 |
| WO | 2007024897 | A3 | 3/2007 |

OTHER PUBLICATIONS

Japanese Office Action issued in Japanese Application No. 2022-523342; dated May 24, 2023; 7 pages.

PCT ISR Written Opinion, International Application No. PCT/US2020/060199; International Filing Date: Nov. 12, 2020; dated Mar. 11, 2021; pp. 1-7.

PCT Notification of Transmittal of The International Search Report ISR, International Application No. PCT/US2020/060199; International Filing Date: Nov. 12, 2020; dated Mar. 11, 2021; pp. 1-6.

Chinese Office Action for Chinese Application No. 202080073223.4; dated Feb. 17, 2023 (pp. 1-11).

International Preliminary Report on Patentability for International Application No. PCT/US2020/060199; International Filing Date Nov. 12, 2020; dated May 27, 2022 (pp. 1-7).

Japanese Final Office Action issued in Japanese Application No. 2022-523342; dated Nov. 15, 2023; 4 pages—With English Translation.

* cited by examiner

TAMPER EVIDENT BLISTER PACKAGING

CROSS REFERENCE TO RELATED APPLICATIONS

This application is a National Stage application of PCT/US2020/060199, filed Nov. 12, 2020, which claims the benefit of U.S. Provisional Application Ser. No. 62/935,446, filed Nov. 14, 2019, both of which are incorporated by reference in their entirety herein.

FIELD

The present disclosure relates to a tamper evident blister package and methods thereof.

BACKGROUND

Conventional packaging of products such as food items and drug products likely to be ingested by consumers has involved considerations such as preventing physical damage to the product or maintaining the product free of bacterial, chemical or microbial contamination. More recently, manufacturers of packaged products have also taken into account the possibility that their product may be deliberately interfered with by a third party. Tampering with products is a concern for all goods manufacturers because of the effect such tampering may have on product performance and therefore the reputation and good name of the manufacturer as well as possibly injuring those using the tampered products. The problems faced by those in the food and drug industries, where the products are ingested are particularly acute. Contamination of food and drug products with dangerous materials can have severe consequences.

It is therefore desirable for the retailer, the consumer and the manufacturer to have a method of determining whether or not a package has been altered. In such cases, the product can be rejected to thereby reduce the likelihood of consumption of a product that has been tampered with.

One such conventional method is disclosed in EP0162378 assigned to Intini. Intini concerns a tamper evident package with a blister pack that is sealed between a front layer and a back layer through apertures created through the blister pack. In other words, apertures are formed through the blister pack to allow front/back layers to bond to each other.

Despite such conventional packaging methods, the fact remains that the malicious interference with products still occurs and can result in huge losses, e.g., in lost sales, as well as, consumer confidence.

The invention is therefore directed at a packaging system and method that provides a visual indication of product opening and, therefore of product tampering. The packaging system and method of the present invention is adaptable for use in a variety of environments and may be incorporated into a number of existing packaging apparatuses with minimum effort.

BRIEF SUMMARY

According to an embodiment, a tamper evident blister package is provided comprising a blister assembly defining at least one cavity, the opening of the at least one cavity being at least partially closed by a membrane. Further, a sleeve housing the blister assembly is provided, the sleeve having a top side and a bottom side, the bottom side having a contact window that is aligned with the cavity. Further, a package integrity feature is applied to the bottom side and covers the contact window. The package integrity feature is further applied to the membrane covering the cavity through the contact window.

In addition to one or more of the features described above, or as an alternative, in further embodiments wherein the package integrity feature is a pressure sensitive adhesive.

In addition to one or more of the features described above, or as an alternative, in further embodiments wherein the package integrity feature prevents lateral removal of the blister assembly from the sleeve.

In addition to one or more of the features described above, or as an alternative, in further embodiments wherein the package integrity feature is perforated and circumferentially outlines the contact window of the sleeve.

In addition to one or more of the features described above, or as an alternative, in further embodiments comprising an indicia of origin or manufacture printed over the package integrity feature, and the contact window.

In addition to one or more of the features described above, or as an alternative, in further embodiments wherein the membrane is a foil, plastic or paperboard.

In addition to one or more of the features described above, or as an alternative, in further embodiments wherein the cavity contains a pellet.

In addition to one or more of the features described above, or as an alternative, in further embodiments wherein the sleeve further comprises an access window aligned with the cavity on the top side of the sleeve for allowing pressure dispensing of the pellet through the contact window.

In addition to one or more of the features described above, or as an alternative, in further embodiments wherein the contact window is sufficiently sized to allow the pellet to pass therethrough.

In addition to one or more of the features described above, or as an alternative, in further embodiments wherein the pressure sensitive adhesive is permanent.

In addition to one or more of the features described above, or as an alternative, in further embodiments wherein the pressure sensitive adhesive includes an elastomer and a tackifier.

In addition to one or more of the features described above, or as an alternative, in further embodiments wherein the elastomer is a natural rubber, vinyl ether, acrylic, butyl rubber, styrene block copolymer, silicone or nitrile.

In addition to one or more of the features described above, or as an alternative, in further embodiments tackifier is a terpene, aromatic resin, hydrogenated hydrocarbon.

According to another embodiment, a tamper evident blister package is provided comprising a blister assembly defining at least one cavity for housing a pellet. Further, a sleeve housing the blister assembly is provided, the sleeve including a bottom side defining a contact window that is vertically aligned with the cavity. Further a package integrity feature is applied over the contact window and wherein, through the contact window, the package integrity feature is further applied to an area of the blister assembly defining the cavity.

In addition to one or more of the features described above, or as an alternative, in further embodiments wherein the package integrity feature is a pressure sensitive adhesive.

In addition to one or more of the features described above, or as an alternative, in further embodiments wherein the package integrity feature prevents lateral removal of the blister assembly from the sleeve.

In addition to one or more of the features described above, or as an alternative, in further embodiments wherein the package integrity feature is perforated and circumferentially outlines the contact window of the sleeve.

In addition to one or more of the features described above, or as an alternative, in further embodiments comprising an indicia of origin or manufacture printed over the package integrity feature, and the contact window.

In addition to one or more of the features described above, or as an alternative, in further embodiments wherein the sleeve further comprises an access window aligned with the cavity on the top side of the sleeve for allowing pressure dispensing of the pellet through the contact window.

In addition to one or more of the features described above, or as an alternative, in further embodiments wherein the pressure sensitive adhesive is permanent.

In addition to one or more of the features described above, or as an alternative, in further embodiments wherein the pressure sensitive adhesive includes an elastomer and a tackifier.

In addition to one or more of the features described above, or as an alternative, in further embodiments wherein the elastomer is a natural rubber, vinyl ether, acrylic, butyl rubber, styrene block copolymer, silicone or nitrile.

In addition to one or more of the features described above, or as an alternative, in further embodiments wherein the tackifier is a terpene, aromatic resin, hydrogenated hydrocarbon resin or terpene-phenol resin.

According to yet another embodiment, a method of manufacturing a tamper evident blister package is provided comprising the acts of providing a blister assembly defining at least one cavity, the opening of the at least one cavity being at least partially closed by a membrane. Further, housing the blister assembly in a sleeve, the sleeve having a top side and a bottom side, the bottom side having a contact window that is aligned with the cavity. Further, applying a package integrity feature applied to the bottom side and covering the contact window; and applying the package integrity feature to the membrane covering the cavity through the contact window.

In addition to one or more of the features described above, or as an alternative, in further embodiments wherein the package integrity feature is a pressure sensitive adhesive.

In addition to one or more of the features described above, or as an alternative, in further embodiments wherein the package integrity feature prevents lateral removal of the blister assembly from the sleeve.

In addition to one or more of the features described above, or as an alternative, in further embodiments comprising the act of perforating the package integrity feature and circumferentially outlining the contact window of the sleeve.

In addition to one or more of the features described above, or as an alternative, in further embodiments comprising the act of printing an indicia or origin or manufacture over the package integrity feature, and the contact window.

According to yet another embodiment, a method of manufacturing a tamper evident blister package is provided comprising the acts of providing a blister assembly defining at least one cavity for housing a pellet and housing the blister assembly in a sleeve, the sleeve including a bottom side defining a contact window that is vertically aligned with the cavity. Further, applying a package integrity feature over the contact window and wherein, through the contact window, the package integrity feature is further applied to an area of the blister assembly defining the cavity.

In addition to one or more of the features described above, or as an alternative, in further embodiments wherein the package integrity feature is a pressure sensitive adhesive.

In addition to one or more of the features described above, or as an alternative, in further embodiments wherein the package integrity feature prevents lateral removal of the blister assembly from the sleeve.

In addition to one or more of the features described above, or as an alternative, in further embodiments comprising the act of perforating the package integrity feature and circumferentially outlining the contact window of the sleeve.

In addition to one or more of the features described above, or as an alternative, in further embodiments comprising the act of printing an indicia or origin or manufacture over the package integrity feature, and the contact window

BRIEF DESCRIPTION OF THE DRAWINGS

The accompanying drawings incorporated in and forming a part of the specification embodies several aspects of the present invention and, together with the description, serve to explain the principles of the invention. In the drawings.

DETAILED DESCRIPTION

Figure 1:
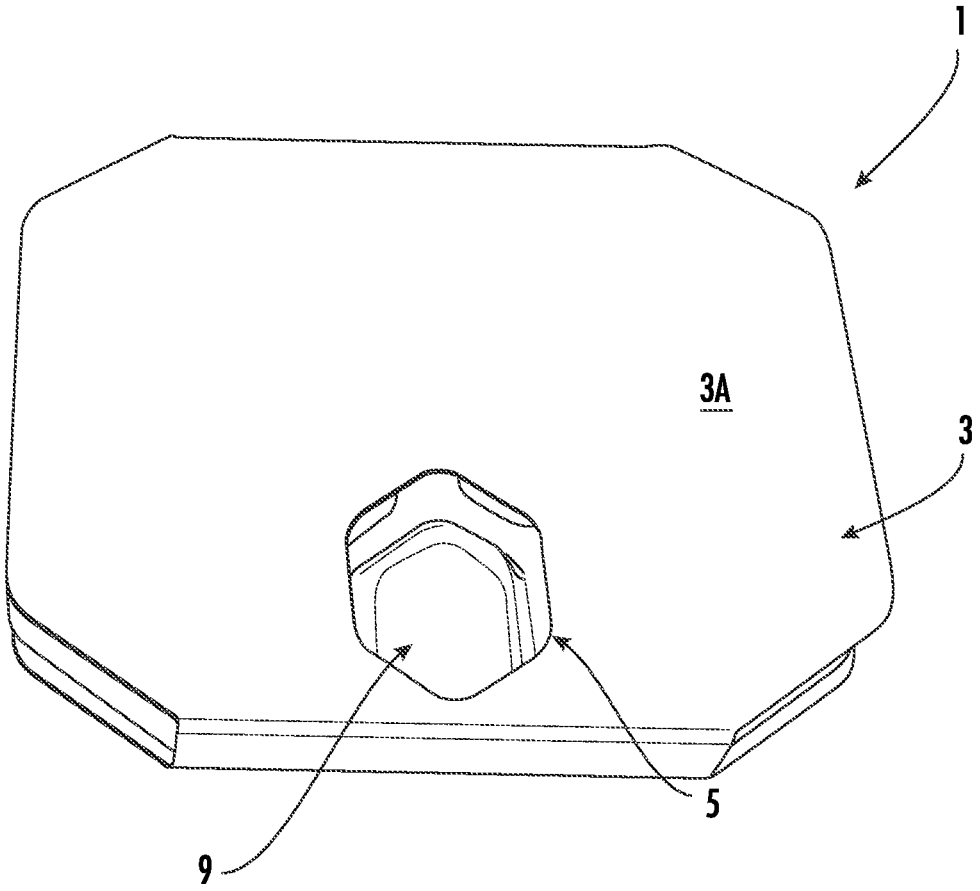
FIG. 1 is a plan view illustrating a front side of the tamper evident blister package according to an embodiment.

The following disclosure will detail particular embodiments that provide improvements for tamper/integrity evident packages and methods wherein a pressure-sensitive adhesive layer is, in one embodiment, bonded to the backing material of the blister cavity and/or compartment through a contact window that is provided in the sleeve. The contact window is provided with an opening sufficient to allow any products and/or pellets in the blister cavity to be released therefrom. The pressure sensitive adhesive layer may be optionally perforated in a manner generally, vertically aligned with the contact window.

Referring now the drawings, FIGS. 1-5 disclose a tamper evident blister package 1, having a sleeve 3 with a top side 3A and a bottom side 3B. Package 1 houses a blister assembly 12 with a cavity 7, which contains a consumable product or pellet 9. Pellet 9 can be any one of a food product, such as chewing gum or other confectionary or pharmaceutical pill as desired. The sleeve 3 may have cut outs 13 on the bottom side 3B to allow easy reach and access to the blister assembly 12. One or more access windows 5 that allow for user interaction via digital pressure or force to dispense the pellet 9 from the cavity 7 may also be provided. User access and interaction with the pellet 9 in the blister assembly 12 may be accomplished by pressure or other means directly on the top side 3A via visual location cues, such as, indents or outline provided on the sleeve 3.

Figure 2:
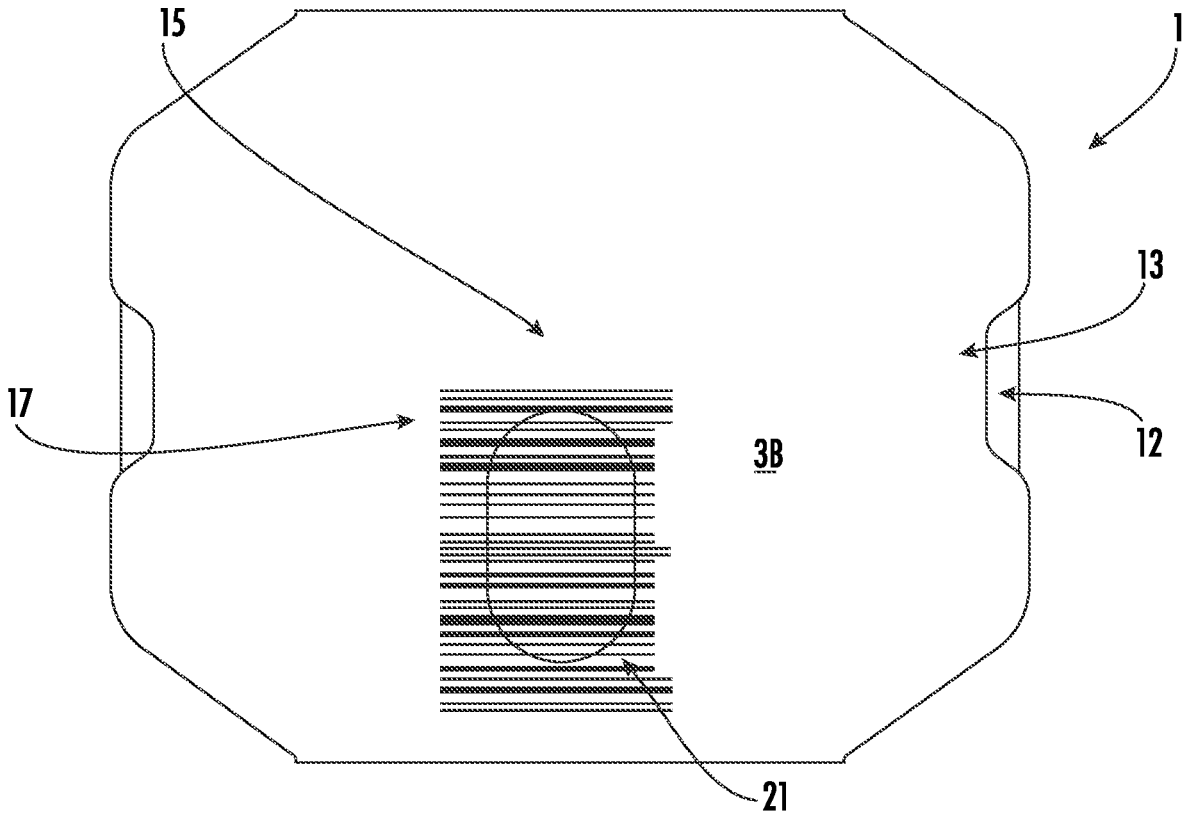
FIG. 2 is a plan view illustrating a back side of the tamper evident blister package having the pressure sensitive adhesive applied thereon along with an indicia or origin or manufacture according to an embodiment.
Figure 3:
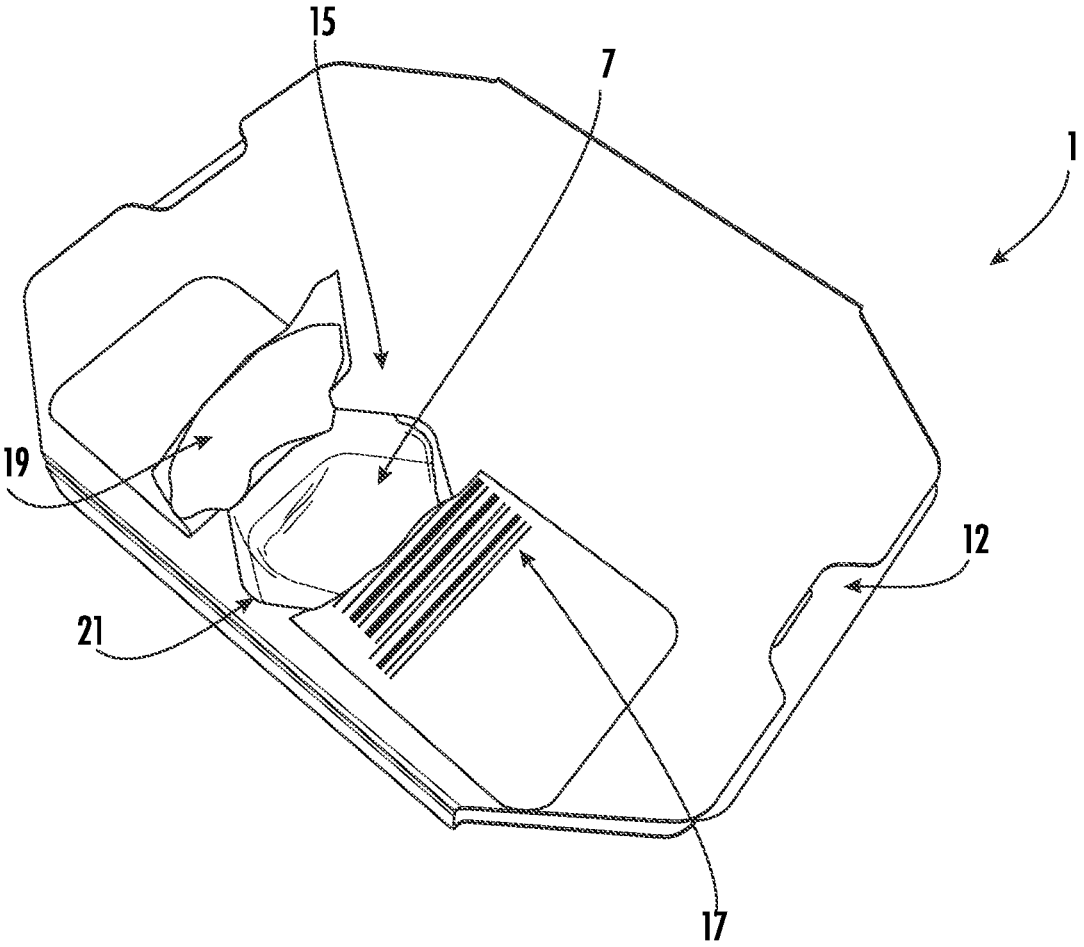
FIG. 3 is a plan view illustrating a back side of the tamper evident blister package in a tampered state according to an embodiment.

As shown in FIGS. 2 and 3, contact window 21 is provided on the bottom side 3B of sleeve 3 directly over and vertically aligned with at least one of the blister cavities 7. The contact window 21 is aligned opposite access window 5 and has an opening that is sufficiently wide to allow the pellet 9 to be dispensed from the cavity 7. Once the product/pellet 9 has been packaged in the cavity 7 of the blister assembly 12, the blister assembly 12 is slidably inserted into the sleeve 3 wherein the contact window 21 vertically aligns with any one the blister cavities 7. The cavity 7 may be enclosed by a membrane or backing material 19, such as, foil, plastic or paperboard. Multiple contact windows 21 can be created in the sleeve 3 as desired.

Thereafter, a package integrity feature 15 (e.g., pressure-sensitive adhesive layer) is applied to the bottom side 3B of the sleeve 3 over the contact window 21. This adhesive layer 15 then bonds to both the sleeve 3 and the backing material 19 of the blister cavity 7 through the contact window 21, locking the sleeve 3 and the blister assembly 12 together (via the backing material 19). The adhesive layer 15 may be provided over a substantial entirety of the bottom side 3B of sleeve 3 or more narrowly configured, e.g., only over the contact window 21. Note, that the improvements of the tamper evident package 1 of the present invention may still be accomplished by directly adhering the pressure sensitive adhesive 15 to the cavity 7 of the sleeve 3, without the use of a membrane 19 where the package of pellet 9 does not further require such use of a membrane 19. In such configuration, the adhesive layer 15 would directly bond the sleeve 3 and the blister assembly 12 together.

Further, as shown in FIGS. 2 and 3 below, the contact window 21 is optionally covered by some indicia of origin or manufacture 17, e.g., a UPC label. In this way, the indicia 17 would make it visually detectable if the seal had been broken and prevent the item from being purchased (i.e., could not be scanned at the register). Alternatively, indicia 17 could also contain additional features to indicate that it is made by the original manufacturer and was not a counterfeit.

Adhesive layer 15 may be formed of an elastomer and a tackifier. The elastomer may be a material such as but not limited to a natural rubber, vinyl ether, acrylic, butyl rubber, styrene block copolymer, silicone or nitrile. The tackifier may be a material such as but not limited to a terpene, aromatic resin, hydrogenated hydrocarbon resin or terpene-phenol resin. The adhesive layer 15 may be permanent or temporary.

Figure 4:
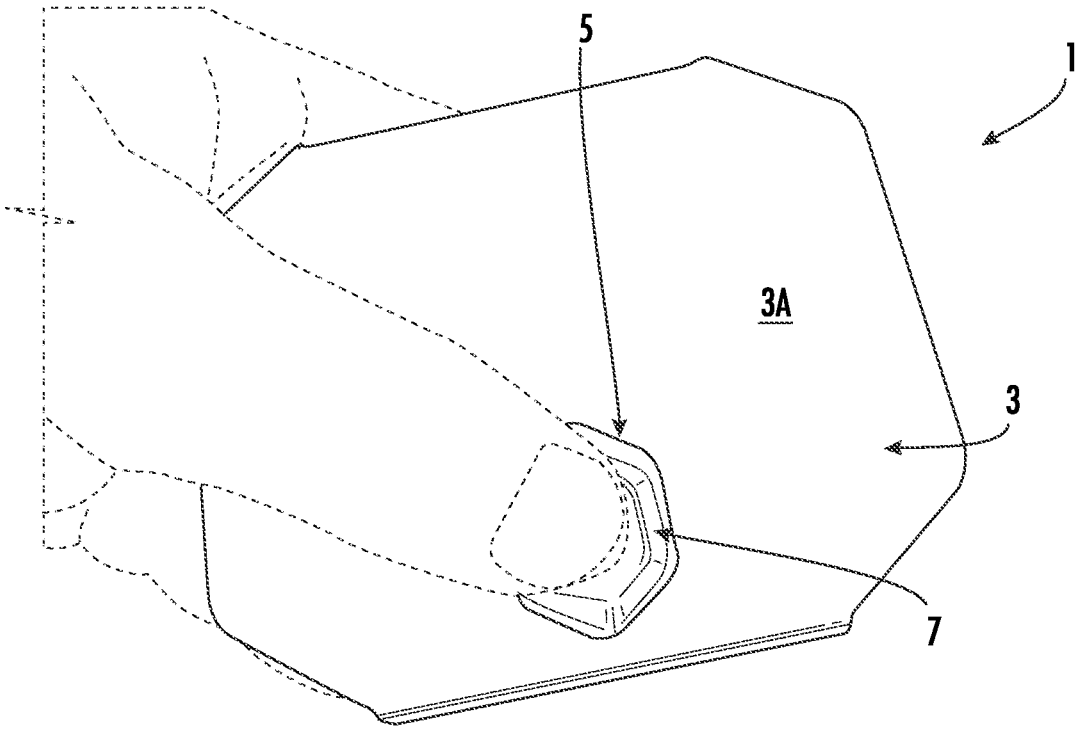
FIG. 4 is a plan view illustrating a front side of the tamper evident blister package with user pressure being applied to the cavity to dispense the pellet through the access window according to an embodiment.
Figure 5:
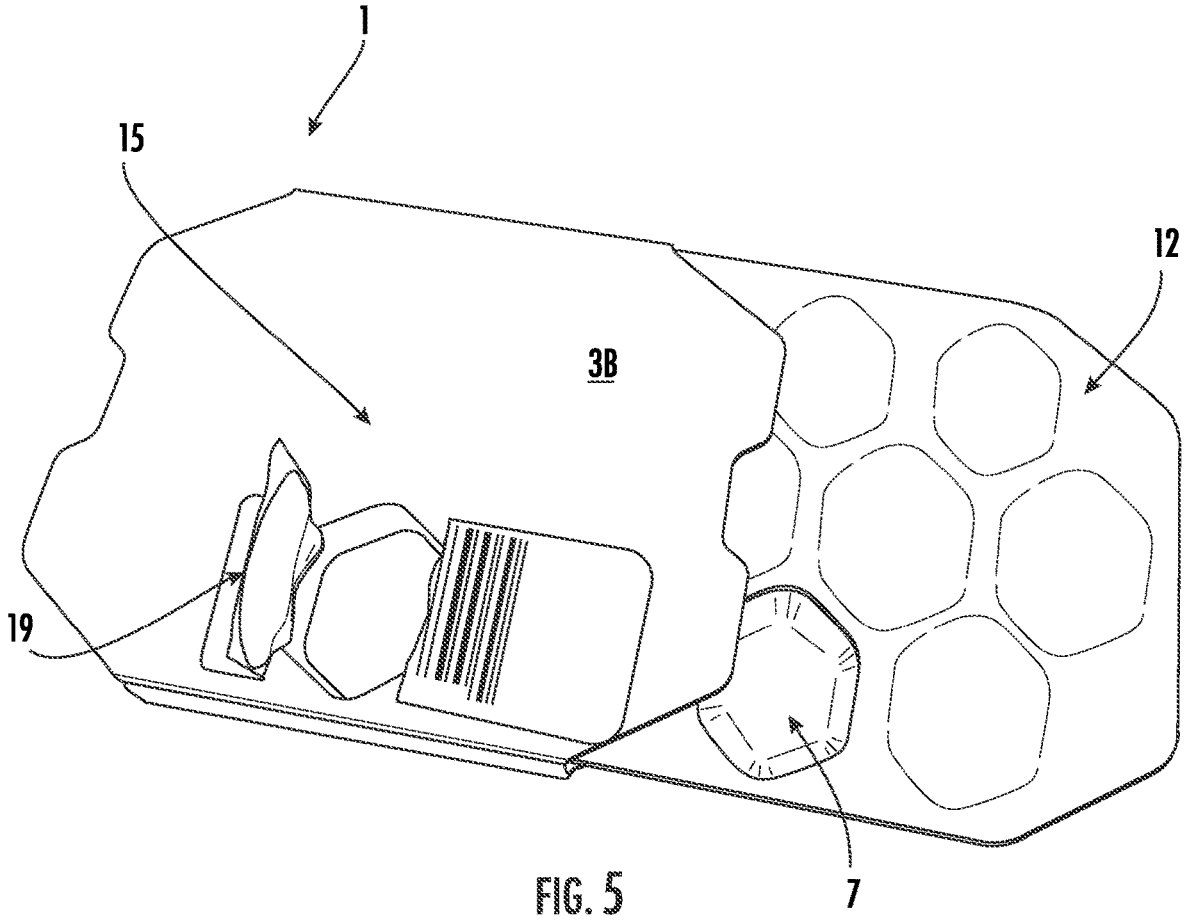
FIG. 5 is a plan view illustrating a back side of the tamper evident blister package in a tampered state, with the blister assembly removed from the sleeve according to an embodiment.

As can be seen from FIGS. 4 and 5, user pressure on the access window 5 to dispense the pellet 9 through the blister cavity 7, as well as sliding/removing the blister assembly 12 would compromise the pressure-sensitive adhesive layer 15, providing indicia of tamper. As shown, the contact window 21 in the bottom side 3B of the sleeve 3 is shown, with the optional (open) perforated adhesive layer 15 that creates a cleaner appearance when accessed by user. In other words, the perforation of the adhesive layer 15 would generally outline the periphery of the contact window 21. Also, the optionally printed indicia or origin or manufacture 17 (e.g., UPC label), once broken, provides additional indications of prior tamper or access to the product/pellet 9.

Figure 6:
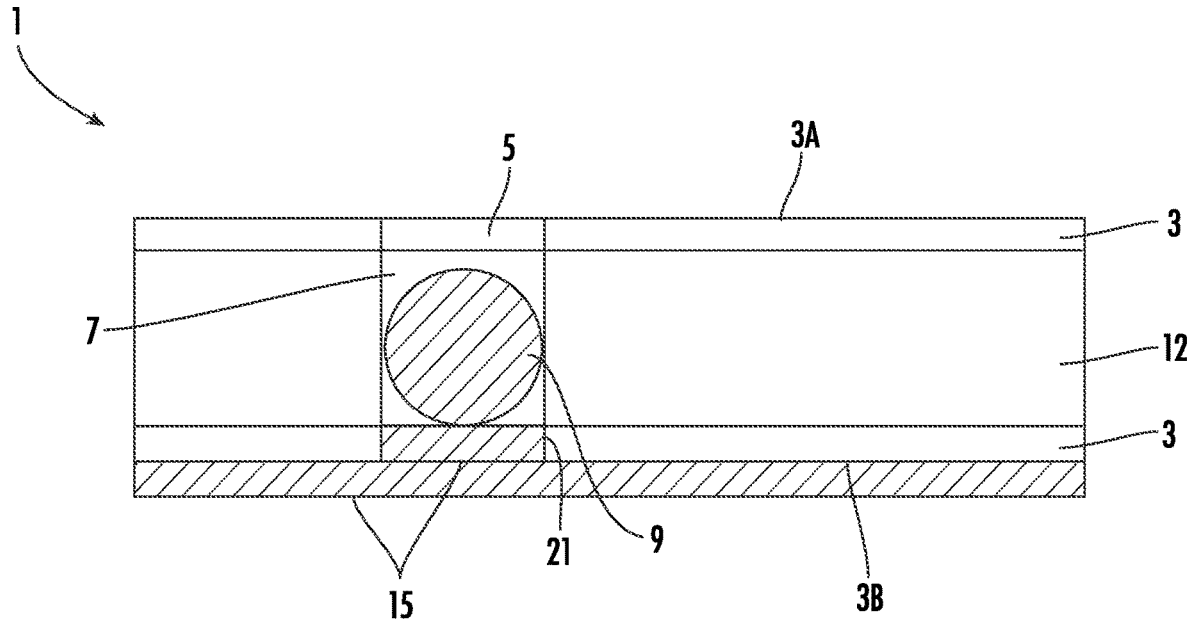
FIG. 6 is a side-sectional view illustrating the tamper evident blister package according to an embodiment.

Referring now to FIG. 6, there is shown a side-sectional view of the tamper evident blister package 1 of the present invention. Package 1 has a sleeve 3 with a top side 3A and a bottom side 3B, with a blister assembly 12 slidingly provided therein. The assembly 12 further includes a cavity 7 that houses a pellet 9 as desired. The sleeve 3 further provides an access window 5 that allows for user interaction via digital pressure or force to dispense the pellet 9 from the cavity 7.

Still referring to FIG. 6, contact window 21 is provided on the bottom side 3B of sleeve 3 directly over and vertically aligned with at least one of the blister cavities 7. The contact window 21 has an opening that is sufficiently wide to allow the pellet 9 to be dispensed from the cavity 7. As can be seen, the blister assembly 12 is slidably inserted into the sleeve 3 wherein the contact window 21 vertically aligns with any one the blister cavities 7. The cavity 7 may be enclosed by an optional membrane or backing material (not shown). Multiple contact windows 21 can be created in the sleeve 3 as desired.

As shown, a pressure-sensitive adhesive layer 15 is applied to the bottom side 3B of the sleeve 3 over the contact window 21. This adhesive layer 15 then bonds to both the sleeve 3 of the blister cavity 7 through the contact window 21, locking the sleeve 3 and the blister assembly 12 together. The adhesive layer 15 may be provided over a substantial entirety of the bottom side 3B of sleeve 3 or more narrowly configured, e.g., only over the contact window 21.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tamper evident blister package comprising:

a blister assembly defining at least one cavity, the opening of the at least one cavity being at least partially closed by a membrane;

a sleeve housing the blister assembly, the sleeve having a top side and a bottom side, the bottom side having a contact window that is aligned with the cavity;

a package integrity feature applied to the bottom side and covering the contact window; and wherein the package integrity feature is further applied to the membrane covering the cavity through the contact window.

2. The package of claim 1, wherein the package integrity feature is a pressure sensitive adhesive.

3. The package of claim 1, wherein the package integrity feature prevents lateral removal of the blister assembly from the sleeve.

4. The package of claim 1, wherein the package integrity feature is perforated and circumferentially outlines the contact window of the sleeve.

5. The package of claim 1, further comprising an indicia of origin or manufacture printed over the package integrity feature, and the contact window.

6. The package of claim 1, wherein the cavity includes a pellet and the sleeve further comprises an access window aligned with the cavity on the top side of the sleeve for allowing pressure dispensing of the pellet through the contact window.

7. The package of claim 6, wherein the contact window is sufficiently sized to allow the pellet to pass therethrough.

8. A tamper evident blister package comprising:

a blister assembly defining at least one cavity for housing a pellet;

a sleeve housing the blister assembly, the sleeve including a bottom side defining a contact window that is vertically aligned with the cavity;

a package integrity feature applied over the contact window; and wherein, through the contact window, the package integrity feature is further applied to an area of the blister assembly defining the cavity.

9. The package of claim 8, wherein the package integrity feature is a pressure sensitive adhesive.

10. The package of claim 8, wherein the package integrity feature prevents lateral removal of the blister assembly from the sleeve.

11. The package of claim 8, wherein the package integrity feature is perforated and circumferentially outlines the contact window of the sleeve.

12. The package of claim 8, further comprising an indicia of origin or manufacture printed over the package integrity feature, and the contact window.

13. The package of claim 8, wherein the sleeve further comprises an access window aligned with the cavity on the top side of the sleeve for allowing pressure dispensing of the pellet through the contact window.

14. A method of manufacturing a tamper evident blister package comprising:

providing a blister assembly defining at least one cavity, the opening of the at least one cavity being at least partially closed by a membrane;

housing the blister assembly in a sleeve, the sleeve having a top side and a bottom side, the bottom side having a contact window that is aligned with the cavity;

applying a package integrity feature applied to the bottom side and covering the contact window; and applying the package integrity feature to the membrane covering the cavity through the contact window.

15. The method of claim 14, wherein the package integrity feature is a pressure sensitive adhesive.

16. The method of claim 14, wherein the package integrity feature prevents lateral removal of the blister assembly from the sleeve.

17. The method of claim 14, further comprising the act of perforating the package integrity feature and circumferentially outlining the contact window of the sleeve.

18. The method of claim 14, further comprising the act of printing an indicia or origin or manufacture over the package integrity feature, and the contact window.

19. A method of manufacturing a tamper evident blister package comprising:

providing a blister assembly defining at least one cavity for housing a pellet;

housing the blister assembly in a sleeve, the sleeve including a bottom side defining a contact window that is vertically aligned with the cavity;

applying a package integrity feature over the contact window; and wherein, through the contact window, the package integrity feature is further applied to an area of the blister assembly defining the cavity.

20. The method of claim 19, wherein the package integrity feature is a pressure sensitive adhesive.

21. The method of claim 19, wherein the package integrity feature prevents lateral removal of the blister assembly from the sleeve.

22. The method of claim 19, further comprising the act of perforating the package integrity feature and circumferentially outlining the contact window of the sleeve.

23. The method of claim 19, further comprising the act of printing an indicia or origin or manufacture over the package integrity feature, and the contact window.

* * * * *